United States Patent [19]

Saita et al.

[11] Patent Number: 4,913,087

[45] Date of Patent: Apr. 3, 1990

[54] DEVELOPING DEVICE OF A COPIER

[75] Inventors: Sinsuke Saita; Shunju Anzai, both of Nara, Japan

[73] Assignee: Sharp Kabushiki Kaisha, Osaka, Japan

[21] Appl. No.: 218,562

[22] Filed: Jul. 13, 1988

[30] Foreign Application Priority Data

| | | | |
|---|---|---|---|
| Jul. 16, 1987 | [JP] | Japan | 62-178467 |
| Jul. 25, 1987 | [JP] | Japan | 62-185772 |
| Aug. 26, 1987 | [JP] | Japan | 62-213778 |
| Aug. 26, 1987 | [JP] | Japan | 62-213779 |
| Aug. 26, 1987 | [JP] | Japan | 62-213780 |

[51] Int. Cl.[4] ..... G03G 15/08H4

[52] U.S. Cl. ..... 118/653; 355/260; 222/DIG. 1; 222/109; 222/325

[58] Field of Search ..... 118/653, 644, 656–658; 355/3 DD; 222/DIG. 1, 109, 325, 481, 482

[56] References Cited

U.S. PATENT DOCUMENTS

| | | | |
|---|---|---|---|
| 4,417,802 | 11/1983 | Forbes | 355/3 D D |
| 4,460,267 | 7/1984 | Ogawa | 355/3 D D |
| 4,611,899 | 9/1986 | Kasamura et al. | 355/3 D D |
| 4,632,534 | 12/1986 | Shimono | 355/3 D D |
| 4,688,926 | 8/1987 | Manno | 118/653 X |
| 4,692,018 | 9/1987 | Taumera | 355/3 D D |
| 4,740,808 | 4/1988 | Kasamura et al. | 355/3 D D |
| 4,754,301 | 6/1988 | Kasamura et al. | 355/3 D D |
| 4,768,055 | 8/1988 | Takamatsu et al. | 355/3 D D |

*Primary Examiner*—R. L. Moses

*Attorney, Agent, or Firm*—Floehr, Hohbach, Test, Albritton & Herbert

[57] ABSTRACT

A developing device for a copier has a cartridge detachably attached to its housing. An outlet and an inlet provided with lids connect the interiors of the cartridge and the housing but developing agent can be supplied from the cartridge to the housing only if the cartridge is properly attached to the housing because the outlet lid is otherwise not opened. When developing agent is deteriorated and to be discarded for replacement, a transporting unit is activated and deteriorated developing agent is collected into the cartridge through its inlet. A sensor for detecting toner concentration inside the housing controls the operation of the transporting unit. Mechanisms are also provided to warn the user if a cartridge which has already been used is inadvertently set.

17 Claims, 6 Drawing Sheets

DEVELOPING DEVICE OF A COPIER

BACKGROUND OF THE INVENTION

This invention relates to a xerographic developing device of an electrophotographic image forming apparatus such as a copier for forming a visible image on a transfer sheet by attaching toner to an electrostatic latent image on a photoreceptor and more particularly to such a developing device provided with a removably attached cartridge such that deteriorated developing agent can be economically and efficiently replaced with a fresh supply.

Among developing devices of this type, there are those for using a single-component developing agent and those for using a two-component developing agent comprised of toner particles which are thermoplastic resin particles and carrier particles of a magnetic substance. A two-component developing agent is stirred inside the developing device and toner is electrostatically adsorbed on carrier surfaces. A magnet roller comprised of a cylindrical sleeve and magnets positioned inside this sleeve is disposed inside the developing device opposite to the copier's photoreceptor. As the sleeve rotates, the carrier particles with toner attached thereon are magnetically adsorbed by the rotating magnetic field which results and are delivered to the surface of the photoreceptor.

Since the electrostatic image formed on the photoreceptor surface is of the polarity opposite to that of the charge on the toner, toner leaves the carrier and is transferred to be attached to the electrostatic latent image on the photoreceptor. In the meantime, the carrier remains on the sleeve and returns to the interior of the developing device. Thus, it is only the toner that is consumed by the developing processes. As for the carrier which is used over and over again, its charging characteristics deteriorate after a repeated use in several thousand to several hundred thousand image forming processes. With a deteriorated carrier, toner cannot be charged to a sufficient voltage and insufficiently charged toner may be attached onto areas on the photoreceptor not having any electrostatic image. This tends to adversely affect the quality of the transferred image. Moreover, if electrostatic adsorption becomes too weak, toner particles will easily fall off from the developing device or the surface of the photoreceptor, and scatter around inside the copier housing. It is therefore necessary to replace the developing agent if the charging characteristics of its carrier have deteriorated.

It is not a simple task to replace developing agent, however, because the carrier, which is a magnetic substance, does not easily come off the sleeve surface of the magnet roller. Moreover, the stirrer for the developing agent is of a complicated shape and makes it difficult to remove the developing agent from the interior of the developing device. It usually requires the service of a trained specialist for the job.

In view of the above, several devices and methods for collecting developing agent have been proposed in order to simplify the replacement of developing agent. Japanese Patent Publication Tokkai No. 54-111354 disclosed a developing tank with a collecting vessel disposed in the circulating route therein and use of a magnet to collect the residual agent at the bottom. Japanese Utility Model Jikko No. 57-55623 disclosed a method of moving a magnetic piece inside the developing tank. Japanese Patent Publication Tokkai No. 60-239775 disclosed a developing tank with a concave bottom surface with an outlet for collecting developing agent. Japanese Patent Publication No. 60-107057 disclosed a developing tank of which a shutter at the bottom along the entire length of its circulating route is openable such that developing agent can be collected into a container removably attached to the bottom. Japanese Patent Publication Tokkai No. 60-140368 disclosed a developing tank separably provided with a device for supplying developing agent and a device for removing residual developing agent. Japanese Patent Publication Tokkai No. 60-153066 disclosed a developing tank having a toner cartridge at the top E and a collection cartridge at the bottom.

A common disadvantage of all these prior art technologies is that a container dedicated for the collection of developing agent must be provided separately from the developing device. This makes the work complicated and troublesome. In view of the above, there have also been copiers of which the developing device is intended to be discarded entirely together with deteriorated developing agent remaining inside. This, however, is economically disadvantageous because relatively expensive, otherwise more durable components contained within the developing tank such as a magnet roller and a toner sensor must also be discarded and hence replaced.

A still further problem to be considered has been that the user could not tell whether the developing agent inside a cartridge which has been set is unused or already deteriorated. The user may therefore be using old developing agent, thinking it is new. If a copy of poor image quality is thereby obtained, the user cannot readily ascertain what has caused the poor result.

SUMMARY OF THE INVENTION

It is therefore an object of the present invention to provide a developing device of a copier which need not be entirely replaced when the developing agent being used therein becomes deteriorated but can be replaced easily, efficiently and inexpensively.

It is another object of the present invention to provide a developing device of a copier with a cartridge attached thereto with which deteriorated developing agent can be efficiently collected into the cartridge before it is detached from the developing device and discarded.

It is still another object of the present invention to provide a developing device of a copier with which the user can easily and reliably ascertain whether deteriorated developing agent therein has been collected for replacement into a cartridge attached to the developing device.

It is still another object of the present invention to provide a developing device of a copier with a detachably attached cartridge for supplying new developing agent and collecting deteriorated developing agent which allows the user to readily ascertain whether the cartridge now attached contains used or deteriorated developing agent.

In view of the above objects, a developing device embodying the present invention includes a cartridge which is detachably attached to its housing for supplying developing agent into the housing and also for collecting it from the housing. For this purpose, the cartridge is provided with two openings, an outlet and an inlet, through which developing agent can move between the interiors of the cartridge and the housing. Lids at these openings are so controlled that developing agent can be supplied from the cartridge into the housing only if the cartridge is securely attached to the housing in an intended manner. Inside the housing is a transporting device for moving developing agent such as a magnetic belt rotatably stretched between belt rollers which can be used not only for stirring and circulating the developing agent during a coping process but also to collect it into the cartridge when it is about to be discarded for replacement. A sensor for measuring toner concentration inside the housing is used to detect how completely developing agent to be discarded has been collected and another sensor may be provided for transmitting a signal indicative of whether a cartridge, when attached to the housing, is an unused one or not to prevent the user from erroneously believing that a fresh supply of developing agent is being used.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

In all these figures, components which are equivalent or similar to one another are indicated by th same numerals.

DETAILED DESCRIPTION OF THE INVENTION

Figure 1:
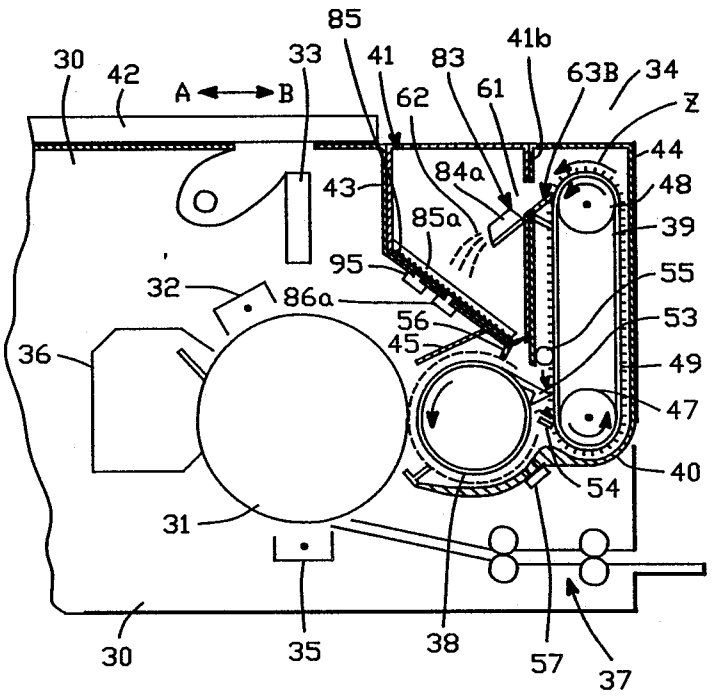
FIG. 1 is a sectional front view of a developing device embodying the present invention and a portion of a copier incorporating this developing device.

In what follows, the present invention is described by way of an example. FIG. 1 shows a developing device 34 embodying the present invention as incorporated in a copier having its photoreceptor disposed at a center part of its housing 30 surrounded not only by the developing device 34 but also by a charger 32, a converging lens array 33 for exposure, an image transfer device and a cleaning device 36 in a well-known manner. Electrostatic latent image formed on the photoreceptor 31 is developed by the developing device 34 and toner image thus formed is transferred onto a copy paper sheet transported by a paper feeding device 37. Described broadly, the developing device 34 is comprised of a housing 40 containing therein a developer roller 38, or a magnet roller, disposed inside a developing tank 45 and a developing agent transporting unit 39 and a supply cartridge 41 for developing agent removably attached to the housing 40 of the developing device 34.

Figure 2:
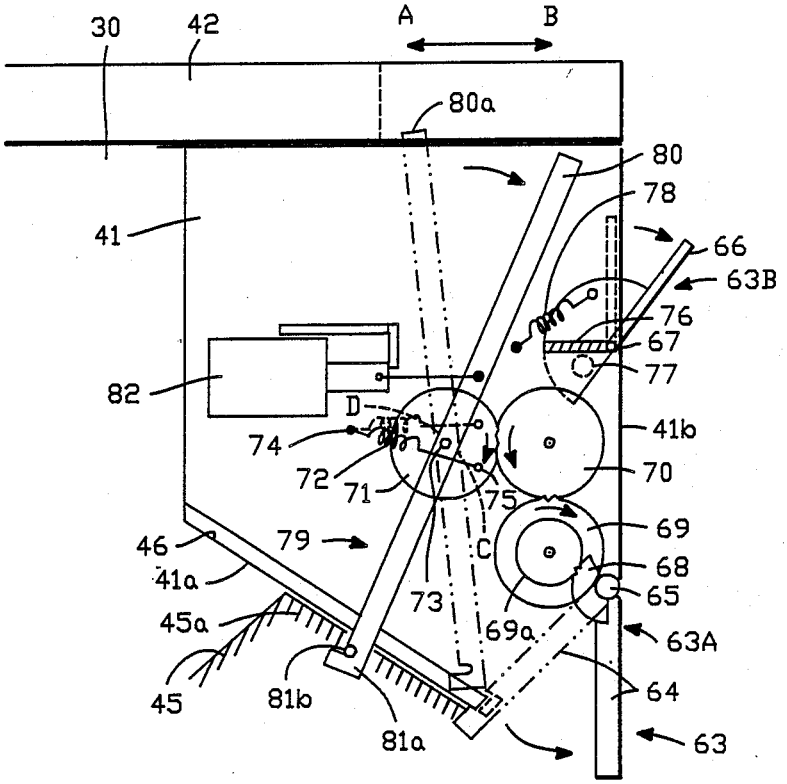
FIG. 2 is a schematic sectional front view of a cartridge to show its opening device.

At the top of the copier housing 30 is a document table 42 placed on rails (not shown) so as to be slidable in the left-right directions indicted by arrows A and B. Adjacent to the developing device 34, an indented section 43 for accepting the cartridge 41 is formed in the shape of a hopper at the top of the copier housing 30 below the document table 42. A container case 44 formed unistructurally with the developing tank 45 for the developing agent transporting unit 39 is disposed adjacent to this indented section 43 and forms a top side edge of the copier housing 30. As shown in FIG. 2, a sloped wall 46 is provided as the bottom surface of the indented section 42 in contact with the top surface **45*a* of the developing tank 45**.

Figure 3:
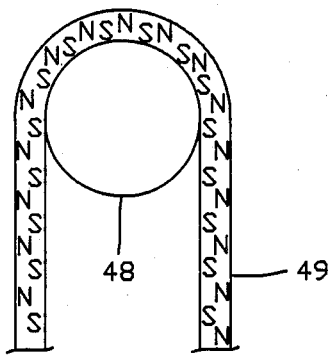
FIG. 3 is a schematic drawing for showing the structure of a portion of the developing agent transporting unit including its magnetic belt.

The developing agent transporting unit 39 is intended to serve not only as a stirrer for mixing the developing agent inside the developer housing 40 but also as a means for collecting deteriorated developing agent into the cartridge 41 as will be explained more fully below. It is essentially comprised of a pair of belt rollers 47 and 48 disposed one below the other inside the container case 44, a magnetic belt 49 stretched engagingly therebetween, and a stirring-transportation motor. The magnetic belt 49 has a magnetic substance dispersedly mixed with an elastic rubber material and may be magnetized as shown in FIG. 3 in the direction from one of its surface to the other. Alternatively, magnetic S and N poles may alternately be formed on the surfaces. With reference to FIG. 1, numeral 53 indicates a scraper plate disposed in contact with the sleeve of the developer roller 38 for scrapping off developing agent and numeral 54 indicates a guiding plate disposed below the scraper plate 53 for catching the scraped developing agent and directing it to the developing agent transporting unit 39. Numeral 55 indicates a toner supply pipe separately attached to the container case 44. Numerals 56 and 57 indicate respectively a doctor blade and a toner concentration sensor.

The interior of the supply cartridge 41 for developing agent is divided, as shown in FIGS. **4*a* and 4B into a storage chamber 58 for developing agent and a front chamber 59 containing an opening device 63 to be explained below. These chambers 58 and 59 are separated by a partition wall 58*a* therebetween. The storage chamber 58 is provided with a supply outlet 60 through which developing agent is supplied to the developer roller 38 and an inlet 61 through which developing agent is collected into the cartridge 41 such that a circulation route 62 for developing agent is formed between the interior of the cartridge 41 and the developer housing 40 as shown in FIG. 1. The storage chamber 58 contains a sufficient amount of developing agent for one replacement cycle. The supply outlet 60 is formed at the bottom end of the sloped bottom wall 41*a* of the cartridge 41. The inlet 61 is formed at an elevated position on a vertical wall 41*b* adjacent to the container case 44**.

The aforementioned opening device 63 is a mechanism for opening and closing the supply outlet 60 and the inlet 61 of the cartridge 41. As shown in FIG. 2, a supply lid 64 for opening and closing the supply outlet 60 is rotatably supported by the vertical wall **41*b* around an axis 65 (hereinafter referred to as the first axis) at the bottom edge thereof and a collection lid 66** for opening and closing the inlet 61 is rotatably supported also by the vertical wall 41*b* around another axis 67 (hereinafter referred to as the second axis) at the lower edge of the inlet 61. The supply lid 64 and the collection lid 66 are closed when the cartridge 41 is pulled off the copier housing 30, preventing the developing agent therein from flowing out.

The mechanism broadly referred to above as the opening device 63 includes what will be hereinafter referred to as an outlet opening mechanism 63A for opening and closing the outlet 60 and an inlet opening mechanism 63B for opening and closing the inlet 61. With reference still to FIG. 2, the outlet opening mechanism 63A is comprised of a fan-shaped gear 68 affixed to the supply lid 64 around the first axis 65 on a side surface of the cartridge 41, a series of gear wheels 69*a*, 69, 70 and 71 engagingly connected to rotate therewith and a spring 72 applying a biasing force on the wheel 71 in the direction of keeping the supply lid 64 open when the supply lid 64 is in open position. The spring 72 is a tensile spring and one end thereof is secured by a pin 74 to a sidewall of the cartridge 41 at a position removed from the center axis 73 of the gear wheel 71 in the direction of the photoreceptor 31. The other end of this spring 72 is affixed by another pin 75 to the gear wheel 71 at a point removed from its center axis 73 in the opposite direction away from the photoreceptor 31.

The inlet opening mechanism 63B is comprised of the collection lid 66, a collection lever 76 which is affixed to an end part of the collection lid 66 and of which the lower end protrudes from the side wall of the cartridge 44, a contact pin 77 which is affixed to the copier housing 30 and comes into contact with the protruding lower end of the collection lever 76 when the cartridge 41 is inserted so as to rotate it in the direction of opening the collection lid 66, and another spring 78 applying a biasing force on the collection lever 76 in the direction of closing the collection lid 66. The length of the collection lid 66 is so determined that its free end away from the second axis 67 touches the magnetic belt 49 as shown in FIG. 1 when it is in fully opened position. The contact pin 77 is so positioned that the collection lid 66 slopes downward in the direction of the interior of the cartridge 41 when the cartridge 41 is set.

Figure 4A:
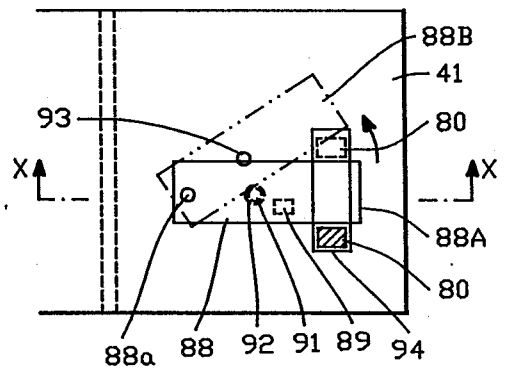
FIG. 4A is a bottom view of a portion of the cartridge, showing the structure of its memory device

The cartridge 41 is further provided with a positioning mechanism 79 as shown in FIG. 2 for setting it properly with respect to the developing tank 45. The positioning mechanism 79 is comprised of a set lever 80 which is affixed to the gear wheel 71 so as to rotate together therewith around its center axis 73 and of which the top end 80*a* protrudes above the sliding surface of the document table 42, a hooking pin 81*b* which is affixed to a side surface of the developing tank 45 and engages with an indentation 81*a* formed on the set lever 80 near its lower end when the cartridge 41 is properly set, and a solenoid 82 which operates to release the set lever 80 from its hooked condition. The solenoid 82 is connected to an upper part of the set lever 80 and is disposed on the side surface of the cartridge 41 on the side of the set lever 80 in the direction of the photoreceptor 31. Both the positioning mechanism 79 and the gear wheels of the opening device 63 are contained inside the aforementioned front chamber 59 at the front part of the cartridge 41 as shown in FIG. 4A.

Figure 5:
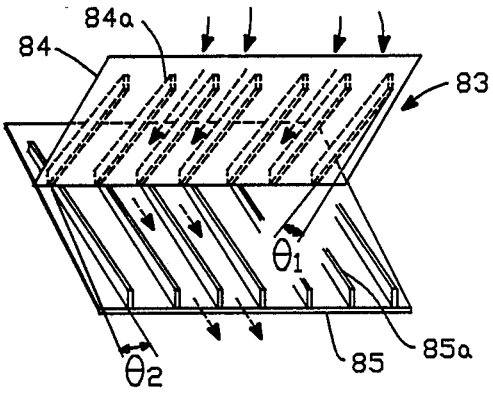
FIG. 5 is a diagonal view of a stirring system in the cartridge shown in FIG. 1.

In side the storage chamber 58 of the cartridge 41 for developing agent, a stirring system 83 for mixing the developing agent is disposed in the aforementioned circulation route 62. As shown in FIGS. 1 and 5, the stirring system 83 is comprised of what are hereinafter referred to as a first stirrer plate 84 and a second stirrer plate 85 together with a plurality of stirrer fins 84*a* and 85*a* protruding therefrom. The first stirrer plate 84 is attached to the vertical wall 41*b* of the cartridge 41 at the bottom edge of its inlet 61, making approximately the same angle with the vertical direction as does the collection lid 66 when it is fully opened so as to touch the magnetic belt 39 as explained above and shown in FIG. 1. The second stirrer plate 85 is disposed on and at the same angle as the sloped bottom wall 41*a* of the cartridge 41. Fins 84*a* on the first stirrer plate 84 are sloped with respect to the latter in one direction by a specified angle $\theta_1$ and the fins 85*a* on the second stirrer plate 85 are sloped with respect to the latter in the opposite direction by another specified angle $\theta_2$ as shown in FIG. 5.

Figure 4B:
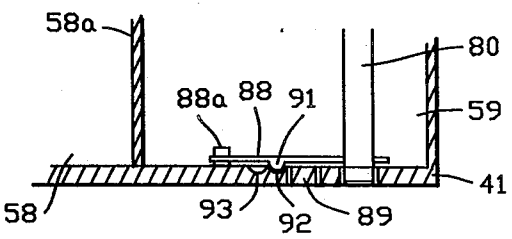
FIG. 4B is a side view taken along the line X—X of FIG. 4A.

In order to enable the user to easily ascertain whether a cartridge 41 contains unused or used developing agent, what is hereinafter referred to as a memory system is provided together with a judging switch 86 as shown in FIG. 1 for making this determination and a supply control unit 87 (to be described below) for allowing the developing agent in the cartridge 41 to be supplied into the developing device 34 only if the cartridge 41 is judged as new. The memory system is disposed inside the front chamber 59 of the cartridge 41 as shown in FIGS. 4A and 4B and is comprised of what will be called a memory plate 88 which is rotatably secured around an axis 88*a* to the bottom surface of the cartridge 41 and can assume selectively an "unused" position 88A and a "used" position 88B, a throughhole 89 formed through this bottom surface, a protrusion 91 made on the memory plate 88, a first indentation 92 and a second indentation 93 formed on the bottom surface of the cartridge 41 such that the protrusion 91 of the memory plate 88 engages with the first indentation 92 if the memory plate 88 is in the "unused" position 88A and with the second indentation 93 if the memory plate 88 is in the "used" position 88B, and the aforementioned set lever 80 which serves, in addition to the functions described above, to move the memory plate 88 from the "unused" position to the "used" position. The bottom surface of the cartridge 41 is additionally provided with an elongated hole 94 which the set lever 80 penetrates and along which it can be moved. Before the cartridge 41 is set onto the copier housing 30, the set lever 80 rests at one end of this elongated hole 94 due to the biasing force of the aforementioned spring 72 and the memory plate 88 is at the center of the elongated hole 94 with its protrusion 91 lightly engaging with the first indentation 92 as explained above. When a new cartridge 41 is set, the set lever 80 rotates around its axis 73 to push the memory plate 88 out of the elongated hole 94 into the "used" position 88B. The judging switch 86 is disposed on the sloped bottom wall 46 of the indented section 43 of the copier housing 30. Numeral 95 of FIG. 1 indicates a detection switch.

Figure 6:
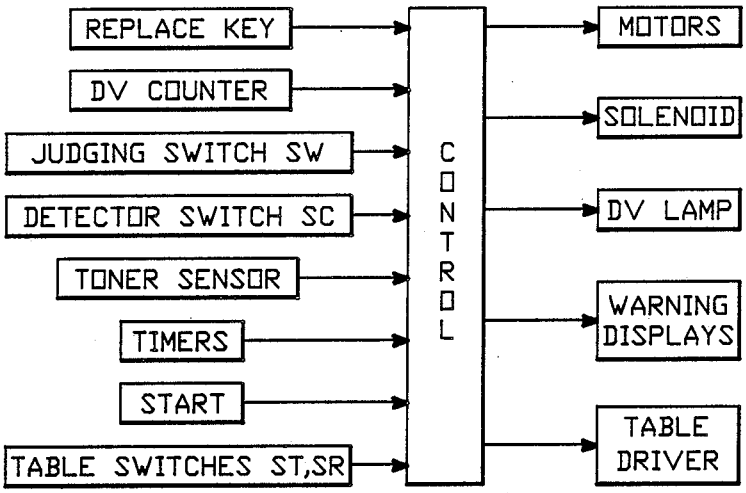
FIG. 6 is a structural diagram for the control unit for the developing device of FIG. 1.

The aforementioned control unit 87 comprises an ordinary one-chip microcomputer and controls the supply and collection of developing agent in response to signals from the memory system and elsewhere. Its functions are schematically illustrated in FIG. 6 and include that of stopping the collection of developing agent at a specified time after the toner concentration sensor 57 detects a certain level of toner concentration. That of operating the opening device 63 in response to a signal from the judging switch 86 when an unused cartridge 41 has been set, that of preventing developing agent from being supplied into the developing device 34 if the signal from the judging switch 86 (denoted as $S_W$ in FIGS. 6 and 7) indicates that used cartridge 41 has been inserted, that of stopping the supply of developing agent and collecting the development agent remaining in the developer housing 30 according to an input from the tone concentration sensor 57, and that of activating the motor 50 during developing and collection periods. Next, operations of these components and functions by this control unit are explained individually more in detail.

When a cartridge 41 is set to the copier housing 30, the document table 42 is pushed to the left as shown in FIG. 1 in the direction of the arrow A to expose the indented section 43 therebelow. If the document table 42 is moved to the right in the direction of the arrow B after the cartridge 41 is inserted from above into this indented section 43, the top end 80*a* of the rotatably support 7 level 80 is pushed to the right causing the set lever 80 to rotate in the clockwise direction. This rotary motion of the set lever 80 is stopped and the cartridge 41 becomes properly positioned when the indentation 8*a* at the bottom end of the set lever 80 engages with the hooking pin 81*b* protruding from the side wall of the developer housing 40. Since the pin 75 for the spring 72 connected to the set lever 80 is positioned below the axis 73 of the set lever 80, the biasing force of the spring 72 acts in the direction of properly positioning the cartridge 41.

After the cartridge 41 has been set to the copier housing 30 but before the set lever 80 finally reaches this properly positioned condition, the judging switch 86 protrudes through the throughhole 89 of the cartridge 41 in the direction of the memory plate 88. If the cartridge 41 is an unused one, the memory plate 88 is at the center of the elongated hole 94 and the judging switch 86 is pressed by the memory plate 88. The user is thereby informed that the developing agent inside this cartridge 41 is a fresh supply. If the cartridge 41 is found to be new, the document table 42 is moved and the set lever 80 is shifted. The memory plate 88 is then pushed by the set lever 80 and rotates around its axis 88*a* to start supplying the developing agent as will be described more fully below. Since the protrusion 91 from the memory plate 88 engages lightly with the second indentation 93 of the cartridge 41, the memory plate 88 remains stationary although the set lever 80 returns to the original position. In other words, developing agent can be supplied when an unused cartridge 41 has been set to the copier housing 30. If a used cartridge 41 is set instead, the judging switch 86 is not activated because the memory plate 88 is at the "used" position 88B. Thus, the control unit 87 can immediately conclude that a used cartridge has been set and stops the positioning of the set lever 80 and other processes.

When the set lever 80 establishes the positioning of the cartridge 41, the gear wheel 71 turns in the clockwise direction, causing the next gear wheel 70 to turn in the counter-clockwise direction and the wheels 69 and 69*a* in the clockwise direction such that the supply lid 64 affixed to the first axis 65 turns therearound to assume an open position. The developing agent inside the cartridge 41 thereby starts to flow into the developer housing 40.

As the cartridge 41 is inserted into the indented section 43 of the copier housing 30, the collection lever 76 comes into contact with the contact pin 77 provided to the copier housing 30. As the cartridge 41 is further pushed downward until its bottom surface is stopped by the top surface 45*a* of the developing tank 45, the collection lever 76 rotates around the second axis 67 to the position shown in FIG. 2. Since the collection lid 66 is unistructurally formed with the collection lever 76, it also rotates by the same angle, stopping at an open position with its top edge lightly pushing the magnetic belt 49.

If the copier is operated with the outlet 60 and the inlet 61 thus opened, the developer roller 38 rotates to the left and the developing agent adsorbed onto its sleeve is controlled to a specified height by the doctor blade 56 and serves to develop an electrostatic latent image formed on the photoreceptor 31. After it passes the neighborhood of the toner concentration sensor 57, a part of it is scraped off the roller surface, falls onto the guiding plate 54 and is transported towards the magnetic belt 49. The toner concentration sensor 57 serves to detect the toner concentration of the developing agent circulating inside the developing tank 45 and transmits a signal to a toner motor (not shown) if the detected toner concentration is too low, thereby causing toner to be added through the toner supply pipe 55 and stabilizing the toner concentration of the developing agent. Toner dropped from the toner supply pipe 55 flows towards the magnetic belt 49 together with a part of the developing agent flowing down from the cartridge 41 above. The magnetic belt 49 is rotating in the counter-clockwise direction. The part of the developing agent scraped off by the scraper plate 53 and the newly supplied toner are mixed together and adsorbed to the magnetic belt 49. After the developing agent is transported up to the top of the belt roller 48, it is scraped off by the collection lid 66 of which the top edge is lightly in contact with the magnetic belt 49 and drops by its own weight into the cartridge 41 through the inlet 61. Once inside the cartridge 41, the developing agent keeps dropping, guided by the first stirrer plate 84 and its fins 48*a* to one side and then by the second stirrer plate 85 and its fins 85*a* to the other side. This change of flow pattern serves to stir the developing agent as it moves downward inside the cartridge 41. The developing agent thus stirred inside the cartridge 41 is supplied towards the developer roller 38 through the supply outlet 60 at the bottom. In summary, the interior of the cartridge 41 itself is utilized as a part of the circulation route 62 along which developing agent travels, while being stirred. This makes it unnecessary to provide a large stirrer unit separately inside the developer housing 40.

When the developing agent has been deteriorated, a replacement command may be inputted from a counter provided in the copier itself or by the user. When such a command signal is received, the document table 42 moves to the left and stops at the position shown in FIG. 1. Next, the solenoid 82 is activated to move the set lever 80 to the position shown by broken lines in FIG. 2. This causes the supply lid 64 through the connected gear wheels 71, 70, 69, 69*a* and 68 to rotate until it closes the outlet 60 of the cartridge 41. At the same time, the indentation 81*a* near the lower end of the set lever 80 is released from the engaged relationship with the hooking pin 81*b*, enabling the cartridge 41 to be pulled upward. When the cartridge 41 is thus removed upward, the contact pin 77 on the copier housing 30 is separated from the collection lever 76. This allows the collection lid 66 to be pulled by the spring 78 and to close the inlet 61 by rotating around the second axis 67.

Figures 1, 7:
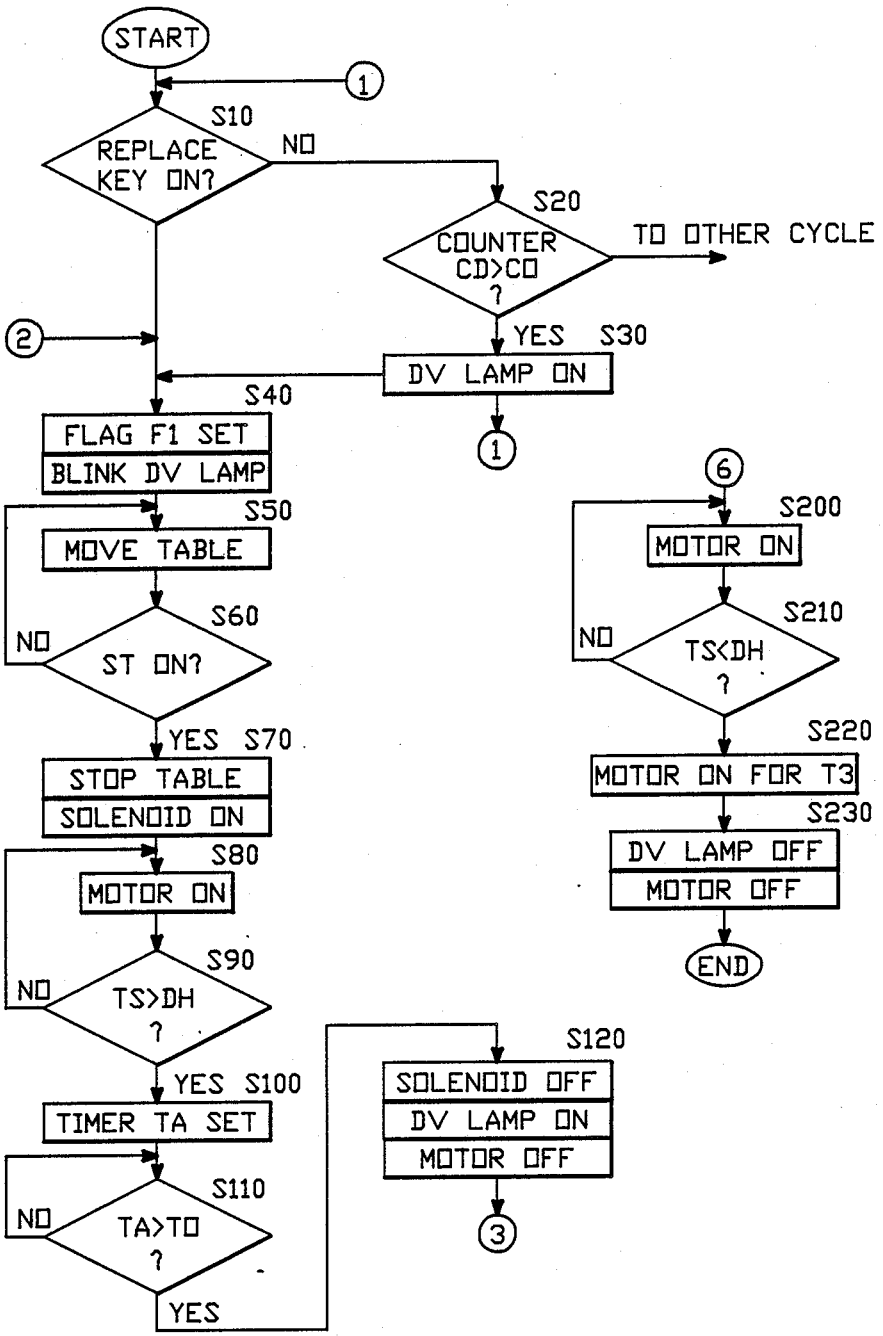
FIG. 7 is a control flow chart of the operations for supplying and collecting developing agent.
Figures 2, 7:
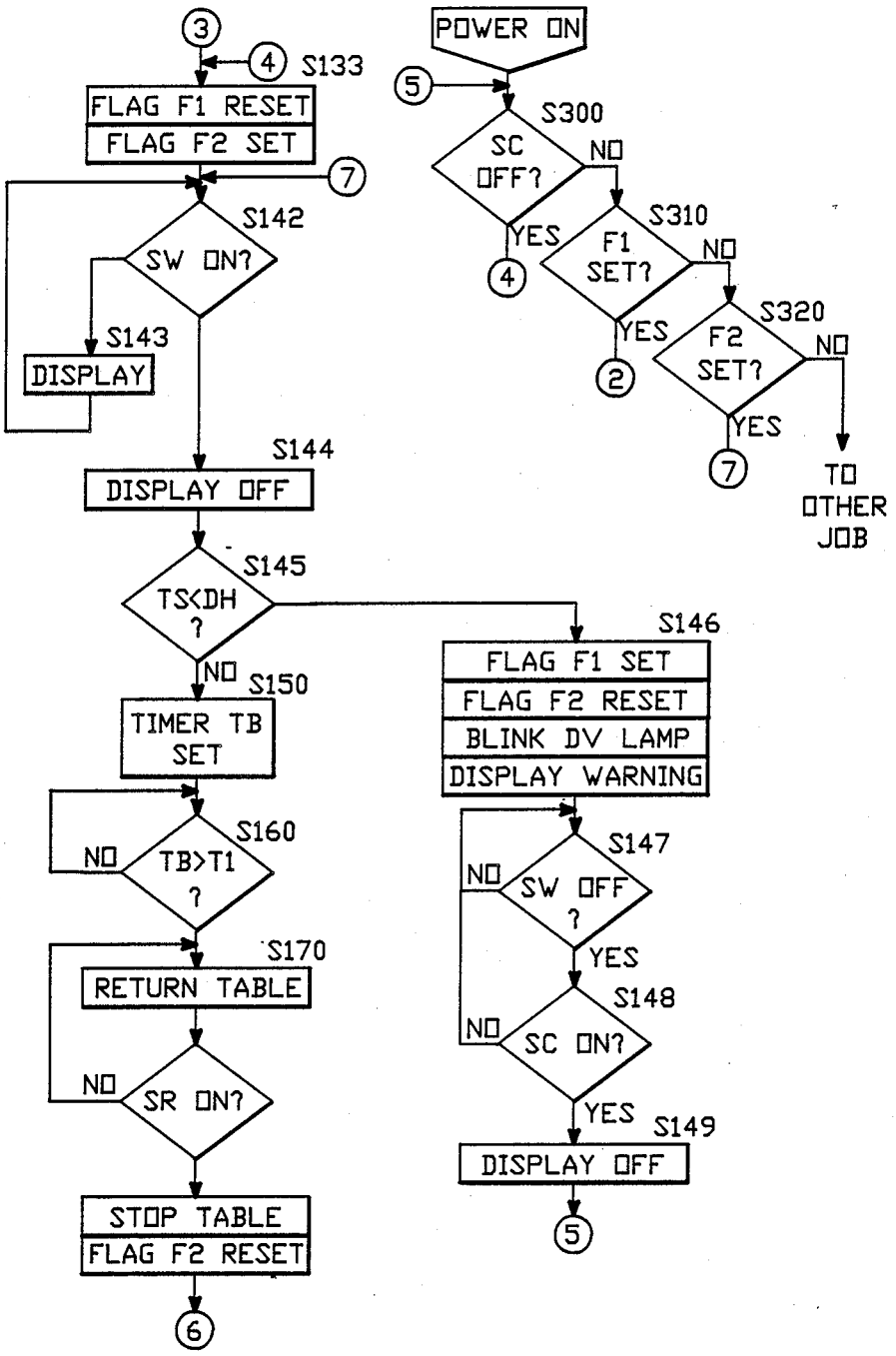

The process of automatically collecting deteriorated developing agent into the cartridge 41 is explained next by way of the flow chart shown in FIG. 7.

The control unit for the copier includes a developer counter (CDV) for keeping record of aging of the developing agent, incrementing its counter value CD each time a copying (image developing) process is performed. When the counter value CD exceeds a preset critical value CO representing the useful lifetime of the developing agent (YES in S20), a warning lamp (DV lamp) is switched on, indicating that time has come to replace the developing agent (S30). When the user notices the warning light or otherwise recognizes deteriorated conditions of the development agent and presses a toner replacement key or the like on the control panel of the copier (YES in S10), Flag 1 is set and the DV lamp begins to blink to indicate that developing agent is being collected (S40). Next, a table feed clutch is switched on to move the document table 42 to the left (S50). When a limit switch (or table overrun detector switch $S_T$ shown in FIG. 6) is turned on (S60) to indicate that the document table 42 has travelled sufficiently far to allow the cartridge 41 to be pulled up, the table 42 is stopped and the solenoid 82 is switched on (S70). The set lever 80 is thereby rotated to the left and the supply outlet 60 is closed.

Next, a motor for the developing device 34 is started (S80) to collect the developing agent from the developer housing 40 into the cartridge 41 by means of the magnetic belt 49. The developing agent which is scraped off from the sleeve of the developer roller 38 by the scraper plate 53 falls on the guiding plate 54 and moves in the direction of the magnetic belt 49. Since the belt rollers 47 and 48 are turning to the left, the developing agent is carried by the magnetic belt 49 to the top of the upper belt roller 48 and thereafter scraped off by the collection lid 66 as explained above to fall into the cartridge 41.

As the developing agent is thus being collected into the cartridge 41, the developer roller 38 receives no supply from above because the outlet 60 of the cartridge 41 remains closed. Accordingly, the toner concentration near the toner concentration sensor 57 drops rapidly. The output signal $T_S$ from the toner concentration sensor 57 accordingly grows rapidly and when it becomes larger than a certain preset magnitude $D_H$ to indicate that the collection of developing agent is nearly completed (YES in S90), a timer $T_A$ is set for measuring a time interval $T_0$ estimated to be necessary for sufficiently collecting the residual developing agent still remaining inside the developer housing 40 (S100). After this timer period has elapsed (YES in S110), the solenoid 82 and the motor are switched off and the user is informed through a display that the collection process has been completed (S120).

When the user thereupon removes the cartridge 41, another limit switch (or cartridge detector switch $S_C$ shown in FIG. 6) is thereby switched off. Flag F1 is reset to indicate that the collection is no longer taking place inside the cartridge 41 and Flag F2 is set to indicate that a new cartridge 41 is inserted (S133). A display requesting the user to insert a new cartridge is made (S143) until the judging switch 86 indicates that a new cartridge 41 has been inserted (YES in S142) and then the display is switched off (S144). Thereafter, existence of developing agent inside the developer housing 40 is examined again by comparing the output signal $T_S$ from the toner concentration sensor 57 with the aforementioned comparison value $D_H$. If the output signal $T_S$ indicates that there is still uncollected developing agent inside for whatever reason (YES in S145), Flag F1 is set, Flag F2 is reset and Steps S300 and thereafter are executed.

If the output signal $T_S$ from the toner concentration sensor 57 indicates that there is no developing agent left in the developer housing 40 (NO in S145), the document table 42 is returned to its starting position after waiting for a timer interval $T_1$ considered to be sufficiently long for the safety of the user. For this purpose, another timer (denoted $T_B$ in FIG. 6) is set (S150) and when the interval $T_1$ is counted thereby (YES in S160), the document table 42 is moved to its starting position, thereby switching on a return detector switch (denoted as $S_R$ in FIG. 7) (S180). Thereupon, the document table 42 is stopped and Flag F2 is reset (S190). The motor for the developer roller 38 is then started (S200) and after the toner concentration sensor 57 detects the new supply of developing agent (YES in S210), the motor is run for a predetermined extra time $T_3$ (S220) counted by still another timer (denoted by $T_C$ in FIG. 6) to completely fill the developer housing 40 with the developing agent. The motor is then stopped (S230).

If power is switched off while developing agent is being replaced, and if power is then switched on again, processing starts from Step S133 if the cartridge detector switch $S_C$ indicates that the cartridge 41 is not set (YES in S300), from Step 40 if Flag F1 is set (YES in S310) and from Step 142 if Flag F2 is set (YES in S320).

Figure 8:
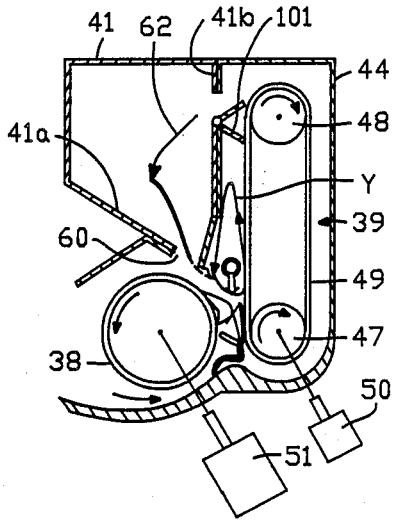
FIG. 8 is a sectional front view of a developing device according to another embodiment of the present invention.

The foregoing description of a preferred embodiment of the present invention has been presented for purposes of illustration and description. It is not intended to be exhaustive or to limit the invention to the precise form disclosed, and many modifications and variations are possible in light of the above teaching. Firstly, FIG. 8 shows a developing device according to another embodiment of the present invention which is similar to the one described above but is characterized as using a separate bidirectional motor for driving the magnetic belt 49 such that the belt rollers 47 and 48 can be selectably rotated in both clockwise and counter-clockwise directions. This can be accomplished, for example, by using a DC motor and applying positive and negative voltages. When it is desired to collect the developing agent into the cartridge 41, the belt rollers 47 and 48 are rotated to the left as explained above and a large circulation route denoted by Z and in part shown at 652 in FIG. 1 is formed. For stirring, or during a regular copying operation, however, the belt rollers 47 and 48 are rotated to the right as indicated by arrows thereon in FIG. 8 such that a smaller circular route denoted by Y in FIG. 8 which does not extend into the cartridge 41 is established. As shown in FIG. 8, there is a blocking blade 101 disposed at an elevated section of the container case 44, protruding therefrom to be in contact with the magnetic belt 49, serving to scrape off developing agent adsorbed on the surface thereof. Since the magnetic belt 49 is turning to the right at this moment, the developing agent scraped off by the scraper plate 53 after being used in a developing process is mixed with a toner-enriched part and adsorbed on the surface of the magnetic belt 49. A part of the developing agent blocked by the blocking blade 101 falls towards the developer roller 38 and is transported towards the photoreceptor 31. In summary, developing agent is not collected into the cartridge 41 during a copying process and circulates only within the developer housing 40. As a result, developing can be effected by a smaller amount of developing agent.

Figure 9B:
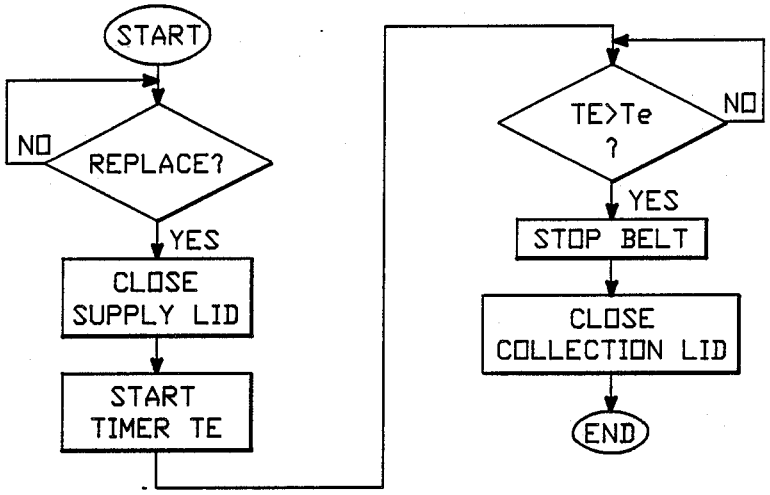
FIG. 9A is a diagonal view of a portion of another developing device embodying the present invention and FIG. 9B is its control flow chart.
Figure 9A:
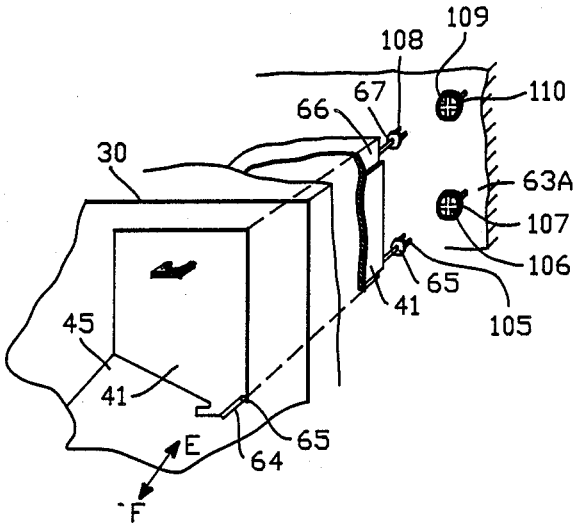

Secondly, the present invention is not limited to cartridges which are designed to be pulled upwards to be removed. FIGS. 9A and 9B show another developing device embodying the present invention characterized as having a cartridge which can be removed by pulling it forward and attached by pushing it backward. According to the embodiment shown in FIGS. 9A and 9B, the outlet opening mechanism 63A is comprised of a pair of engaging pins 105 attached behind the first axis 65, engaging holes 106 formed on the side of the copier housing 30 to detachably engage the pins 105 and a supply ring 107 rotatable by a motor (not shown) and the inlet opening mechanism 63B is comprised of another pair of engaging pins 108 attached behind the second axis 67, engaging holes 109 formed similarly on the side of the copier housing 30 to detachably engage the pins 108 and a collection ring 110 rotatable by another motor to be controlled independently of the motor for the supply ring 107.

As shown by the flow chart in FIG. 9B, when it is determined that time has come to replace the cartridge, say, because more than a specified number of copies has been processed, the supply ring 107 is rotated such that the supply lid 64 is closed. The magnetic belt 49 of the transporting unit 39 is run still for a specified extra length of time $T_e$ such that developing agent inside the developing tank 45 is sure to be collected completely into the cartridge 41. This may be accomplished by a timer denoted by $T_E$ in FIG. 9B in a similar manner as explained in connection with FIG. 7. Thereafter, if the collection ring 110 is rotated to close the collection lid 66, the engaging pins 105 and 108 are now in positions disengagable from the holes 106 and 109, respectively, and the cartridge 41 can be easily pulled forward in the direction of the arrow F to be removed from the developer housing 40. An advantage of this embodiment is that components of the opening device 63 on the side of the cartridge 41 can be made smaller and less costly.

Furthermore, the transporting unit 39 may be comprised of a plurality of magnet rollers or a belt conveyor with indentations. The stirring system 83 is not an essential constituent of the present invention and hence may be dispensed with as well as some of the functions performed by the control system such as those performed by the judging switch 86 and the memory plate 88. In summary, the present invention is intended to be interpreted broadly and any modifications and variations that may be apparent to a person skilled in the art are to be included within the scope of this invention.

What is claimed is:

1. A developing device of a copier, comprising
a housing,
a cartridge detachably attached to said housing, said cartridge having an outlet which can be opened and closed and through which developing agent can be supplied from said cartridge to said housing, and
means for collecting developing agent within said housing into said cartridge.

2. The developing device of claim 1 wherein said cartridge has an inlet and said collecting means include a conveyor belt for adsorbing developing agent thereon and transporting said adsorbed developing agent to sad inlet when said cartridge is attached to said housing.

3. The developing device of claim 2 wherein said cartridge includes outlet controlling means for keeping said outlet closed before said cartridge is properly attached to said housing and opening said outlet when said cartridge is properly attached to said housing.

4. The developing device of claim 1 further comprising collection control means for terminating operation of said collecting means after a preset time interval has passed since a preset level of developing agent concentration inside said housing is detected.

5. A developing device of a copier comprising
a housing containing therein a developer roller and transporting means for transporting developing agent, and
a cartridge which is detachably attached to said housing, said cartridge being formed with an outlet through which developing agent can be supplied to said developer roller and an inlet through which developing agent can be collected from said housing, a circulation route for developing agent being formed through said housing and the interior of said cartridge having opening means for opening and closing said inlet and outlet.

6. The developing device of claim 5 wherein said cartridge contains stirring means in said circulation route for stirring developing agent.

7. The developing device of claim 5 wherein said opening means serve to keep said outlet closed before said cartridge is properly attached to said housing and to open said outlet when cartridge is properly attached to said housing.

8. The developing device of claim 5 wherein said transporting means can be selectably operated in a collection mode for collecting developing agent into said cartridge and in a stirring mode for stirring developing agent inside said housing, and wherein said developing device further comprises control means for selectively operating said transporting means in said collection mode and in said stirring mode.

9. The developing device of claim 8 wherein said transporting means include a conveyor belt adapted to adsorb developing agent thereon and supported rotatably by belt rollers, and a motor means capable of causing said belt rollers to rotate in one direction in said collection mode of operation and in another direction in said stirring mode of operation in response to a signal received from said control means.

10. The developing device of claim 8 wherein a shorter circulation route for developing agent not extending into said cartridge is established entirely within said housing when said transporting means are operating in said stirring mode.

11. The developing device of claim 8 wherein said control means serve to terminate operation of said transporting means in said collection mode after a preset time interval has passed since a preset level of developing agent concentration inside said housing is detected.

12. A developing device of a copier comprising
a housing,
a cartridge detachably attached to said housing,
supplying means for supplying developing agent from said cartridge into said housing,
collecting means for collecting developing agent from within said housing into said cartridge,
a sensor for detecting concentration of developing agent inside said housing, and
control means for controllingly terminating collection of developing agent by said collecting means according to a signal received from said sensor indicative of said concentration of developing agent inside said housing.

13. The developing device of claim 12 wherein said control means terminate collection of developing agent by said collecting means after a preset time interval has passed since a preset level of developing agent concentration is detected by said sensor.

14. The developing device of claim 12 further comprising memory means storing use data item indicative of whether said cartridge has been used or unused, and judging means for judging and transmitting a judgment signal indicative of whether said cartridge has been used or not, said control means also serving to control supply of developing agent from said cartridge into said housing according to said judgment signal.

15. The developing device of claim 14 wherein said control means control supply of developing agent from said cartridge into said housing, if said cartridge is judged to be unused, by detecting whether there is residual developing agent inside said housing.

16. A developing device of a copier, comprising a housing, a cartridge detachably attached to said housing, memory means storing use data item indicative of whether said cartridge has been used or unused, judging means for judging and transmitting a judgment signal indicative of whether said cartridge has been used, and control means for controlling the supply of developing agent from said cartridge into said housing according to said judgment signal.

17. The developing device of claim 16 wherein said control means control supply of developing agent from said cartridge into said housing, if said cartridge is judged to be unused, by detecting whether there is residual developing agent inside said housing.

* * * * *